US011247805B2

(12) United States Patent
Ito et al.

(10) Patent No.: US 11,247,805 B2
(45) Date of Patent: Feb. 15, 2022

(54) RESIN CONTAINER

(71) Applicant: NISSEI ASB MACHINE CO., LTD., Nagano (JP)

(72) Inventors: Michihito Ito, Nagano (JP); Takeshi Aoki, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 94 days.

(21) Appl. No.: 16/498,097

(22) PCT Filed: Mar. 28, 2018

(86) PCT No.: PCT/JP2018/012969
§ 371 (c)(1),
(2) Date: Sep. 26, 2019

(87) PCT Pub. No.: WO2018/181574
PCT Pub. Date: Oct. 4, 2018

(65) Prior Publication Data

US 2020/0231323 A1 Jul. 23, 2020

(30) Foreign Application Priority Data

Mar. 31, 2017 (JP) ..... JP2017-069778

(51) Int. Cl.
*B65D 1/02* (2006.01)

(52) U.S. Cl.
CPC .... *B65D 1/0292* (2013.01); *B65D 2501/0018* (2013.01); *B65D 2501/0081* (2013.01)

(58) Field of Classification Search
CPC ..... B65D 1/0292; B65D 2501/0018; B65D 2501/0036; B65D 2501/0063; B65D 2501/0081
(Continued)

(56) References Cited

U.S. PATENT DOCUMENTS

D211,625 S * 7/1968 Du Pree ..... D7/300
2014/0166650 A1* 6/2014 Kanfer ..... B65D 1/0292 220/6
2015/0129536 A1* 5/2015 Moulin ..... B65D 1/0223 215/382

FOREIGN PATENT DOCUMENTS

CN 101998924 3/2011
CN 203127320 8/2013
(Continued)

OTHER PUBLICATIONS

Office Action dated Jun. 11, 2020 in Chinese Patent Application No. 201880022479.5 and English translation thereof.
(Continued)

*Primary Examiner* — J. Gregory Pickett
*Assistant Examiner* — Niki M Eloshway
(74) *Attorney, Agent, or Firm* — Greenblum & Bernstein, P.L.C.

(57) ABSTRACT

There is provided a resin container including an upper surface portion, a side surface portion connected to the upper surface portion, and a bottom surface portion disposed on a side opposite to the upper surface portion and connected to the side surface portion. A round corner surface portion is formed to the side surface portion. A first folding deformation inducing portion is formed on the round corner surface portion. When the container is viewed from a side surface portion side such that a central axis of the container and the round corner surface portion overlap with each other, the first folding deformation inducing portion is oblique with respect to the central axis.

3 Claims, 7 Drawing Sheets

(58) Field of Classification Search
USPC ..... 215/371, 382, 900; D9/566
See application file for complete search history.

(56) References Cited

FOREIGN PATENT DOCUMENTS

| | | | | | |
|---|---|---|---|---|---|
| CN | 203461221 | | | 3/2014 | |
| GB | 2572581 | A | * | 10/2019 | ..... B65D 1/0292 |
| JP | 10-167243 | A | | 6/1998 | |
| JP | 10-218149 | | | 8/1998 | |
| JP | 2001010625 | A | * | 1/2001 | ..... B65D 1/0292 |
| JP | 2002326619 | A | * | 11/2002 | ..... B65D 79/005 |
| JP | 2003-237758 | | | 8/2003 | |
| JP | 2005-170386 | | | 6/2005 | |
| JP | 2010-042859 | | | 2/2010 | |
| JP | 2012-046216 | | | 3/2012 | |
| KR | 2011-0042034 | A | | 4/2011 | |
| WO | 2016/050977 | | | 4/2016 | |

OTHER PUBLICATIONS

Office Action issued in Korean Patent Application No. 10-2019-7028411 dated Jan. 25, 2021 and English Translation thereof.
Official Communication issued in International Application No. PCT/JP2018/012969, dated May 1, 2018.
Office Action issued in International Application No. PCT/JP2018/012969, dated May 1, 2018.

* cited by examiner

RESIN CONTAINER

TECHNICAL FIELD

The present invention relates to a resin container for a water server.

BACKGROUND ART

In recent years, awareness of health consciousness and need to prepare for natural disasters has increased, and demand for containers referred to as bag in-box (BIB) has increased. The BIB is a composite structural container in which a resin container filled with liquid such as drinking water (mineral water) is accommodated in an exterior body such as a cardboard box or a carton. Storage and transportation are performed in a state where the resin container is accommodated in the exterior body, and when used, the resin container taken out from the exterior body is set in a dispenser (water server) and used for water supply or the like.

The resin container is, for example, a thin container formed by molding a flexible material such as polyethylene terephthalate (PET) with a blow molding machine, and has a capacity of about 5 to 15 liters. The resin container has flexibility, and is crushed by atmospheric pressure with liquid draining when used upside down on the water server. Since such a resin container is a thin container having flexibility, the resin container is particularly used as a disposable (one-way type) container that is crushed and discarded after use.

Patent Literature 1 discloses a container for a water server, which includes a belt-shaped hanging tool having flexibility in vicinity of a bottom surface thereof.

Patent Literature 2 discloses a container for a water dispenser, in which the container is crushed in an axial direction of the container by a force generated by a difference between pressure inside the container and outside air pressure with liquid draining.

CITATION LIST

Patent Literature

Patent Literature 1: JP-A-2012-46216
Patent Literature 2: WO 2016/050977

SUMMARY OF INVENTION

Technical Problem

A soft container for a water server is crushed by atmospheric pressure during use. At this time, the container is irregularly deformed due to flow of water, minute variations in the thickness of the container generated during molding, minute scratches and distortions on the container and the like during transportation or the like. When the container is provided with a side wall portion having round corners instead of having a complete cylindrical shape, the side wall portion may become a support of the container since the side wall portion is not crushed. If the support exists, folding deformation of the container may be inhibited and liquid draining may not be completely performed, resulting in liquid remaining in the container.

An object of the present invention is to provide a resin container for a water server, which can prevent liquid from remaining in the container.

Solution to Problem

The resin container according to the present invention capable of solving the above problems, is a resin container for a water server, which is capable of accommodating a predetermined amount of liquid and has flexibility, the container being crushed with draining of the liquid, the container including:

an upper surface portion to which a liquid inlet and outlet portion is formed;

a side surface portion connected to the upper surface portion; and a bottom surface portion disposed on a side opposite to the upper surface portion and connected to the side surface portion, wherein a round corner surface portion is formed to the side surface portion such that the container has a polygonal shape with round corners when the container is viewed from an upper surface portion side, wherein an elongated first folding deformation inducing portion is formed on the round corner surface portion, and wherein, when the container is viewed from a side surface portion side such that a central axis of the container passing through the liquid inlet and outlet portion and the round corner surface portion overlap with each other, the first folding deformation inducing portion is oblique with respect to the central axis.

According to the resin container configured as above, a force applied to the container in an irregular direction is induced by the first folding deformation inducing portion with liquid draining, so that the round corner surface portion of the container can be prevented from becoming a support. As a result, the container can be crushed such that no liquid remains in the container.

The irregular force is considered to be generated due to flow of water, minute variations in the thickness of the container generated during molding, and minute scratches and distortion on the container and the like during transportation or the like. According to the resin container configured as above, regardless of such state of the container, the container can be crushed such that no liquid remains in the container.

In the resin container according to the present invention, it is preferable that:

an elongated second folding deformation inducing portion is formed on the round corner surface portion, and when the container is viewed from the side surface portion side such that the central axis and the round corner surface portion overlap with each other, the second folding deformation inducing portion is oblique with respect to the central axis at an inclination different from an inclination of the first folding deformation inducing portion with respect to the central axis.

According to this configuration, by providing the two types of folding deformation inducing portions, the round corner surface portion of the container can be further prevented from becoming a support. As a result, the container can be further crushed such that no liquid remains in the container.

In the resin container according to the present invention, it is preferable that:

an elongated third folding deformation inducing portion is formed on the round corner surface portion, and when the container is viewed from the side surface portion side such that the central axis and the round corner surface portion overlap with each other, the third folding deformation inducing portion is orthogonal to the central axis.

By providing the three types of folding deformation inducing portions, the round corner surface portion of the container can be even further prevented from becoming a support. As a result, the container can be even further crushed such that no liquid remains in the container.

In the resin container according to the present invention, it is preferable that:

when the container is viewed from the side surface portion side such that the central axis and the round corner surface portion overlap with each other, in a trapezoid in which the first folding deformation inducing portion and the second folding deformation inducing portion serve as legs, a line connecting end portions of the first folding deformation inducing portion and the second folding deformation inducing portion on the upper surface portion side serves as an upper base, and a line connecting end portions of the first folding deformation inducing portion and the second folding deformation inducing portion on a bottom surface portion side serves as a lower base, the upper base and the lower base are orthogonal to the central axis;

a plurality of the trapezoids are provided in a direction of the central axis;

a height of the trapezoid closest to the upper surface portion is preferably greater than a height of the trapezoid closest to the bottom surface portion; and among adjacent trapezoids; a height of the trapezoid on the upper surface side is equal to or greater than a height of the trapezoid on the bottom surface side.

The side surface portion on the bottom surface portion side is crushed before the side surface portion on the upper surface portion side when the liquid is drained. By reducing the height of the trapezoid in which the first folding deformation inducing portion and the second folding deformation inducing portion on the bottom surface portion side of the container serves as legs, deformation of the container can be easily induced at the beginning of liquid draining, and the round corner surface portion of the container can be prevented from becoming a support. When the liquid draining proceeds, since support by the liquid is lost as the liquid inside decreases, the vertical length of the deformation of the container often increases. By increasing the height of the trapezoid in which the first folding deformation inducing portion and the second folding deformation inducing portion on an upper portion side of the container serve as legs, deformation of the container is easily induced also at the middle and end of the liquid draining, and the round corner surface portion of the container can be prevented from becoming a support. As a result, the container can be crushed such that no liquid remains in the container.

Advantageous Effects of Invention

According to the present invention, a resin container for a water server which is capable of preventing liquid from remaining in the container can be provided.

DESCRIPTION OF EMBODIMENTS

Figure 1:
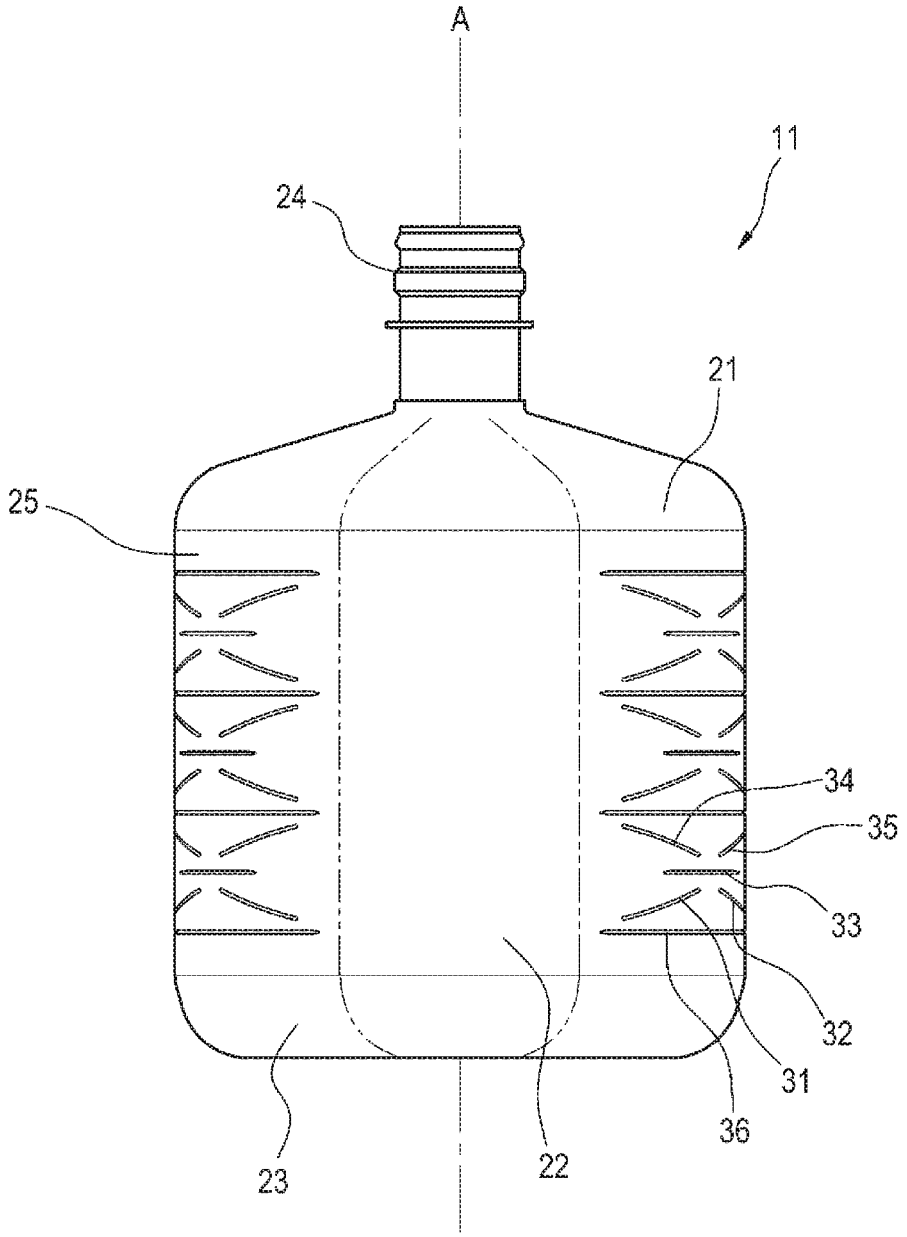
FIG. 1 is a side view showing a resin container for a water server according to a first embodiment of the present invention.

Embodiments of a resin container according to the present invention will be described below with reference to the drawings.

First Embodiment

FIGS. 1 to 4 are views showing a resin container 11 according to a first embodiment of the present invention. In the present embodiment, the resin container 11 includes an upper surface portion 21, a side surface portion 22 connected to the upper surface portion 21, and a bottom surface portion 23 disposed on a side opposite to the upper surface portion 21 and connected to the side surface portion 22, and is formed in a substantially cubic shape. A predetermined amount of liquid (such as drinking water or the like) can be accommodated therein.

The upper surface portion 21 forms a top surface of the resin container 11, and a cylindrical inlet and outlet portion 24 projecting upward is formed at a center thereof. Liquid is introduced into the resin container 11 from the inlet and outlet portion 24. The liquid in the resin container 11 is discharged from the inlet and outlet portion 24. A cap is attached to the inlet and outlet portion 24. The cap can be attached to and detached from the inlet and outlet portion 24, and the resin container 11 is sealed by attaching the cap to the inlet and outlet portion 24.

The side surface portion 22 forms a peripheral surface of the resin container 11, and is connected to the upper surface portion 21 and extends downward. The bottom surface portion 23 forms a bottom surface of the resin container 11, and is disposed on a side opposite to the upper surface portion 21 and is connected to the side surface portion 22.

Figure 2:
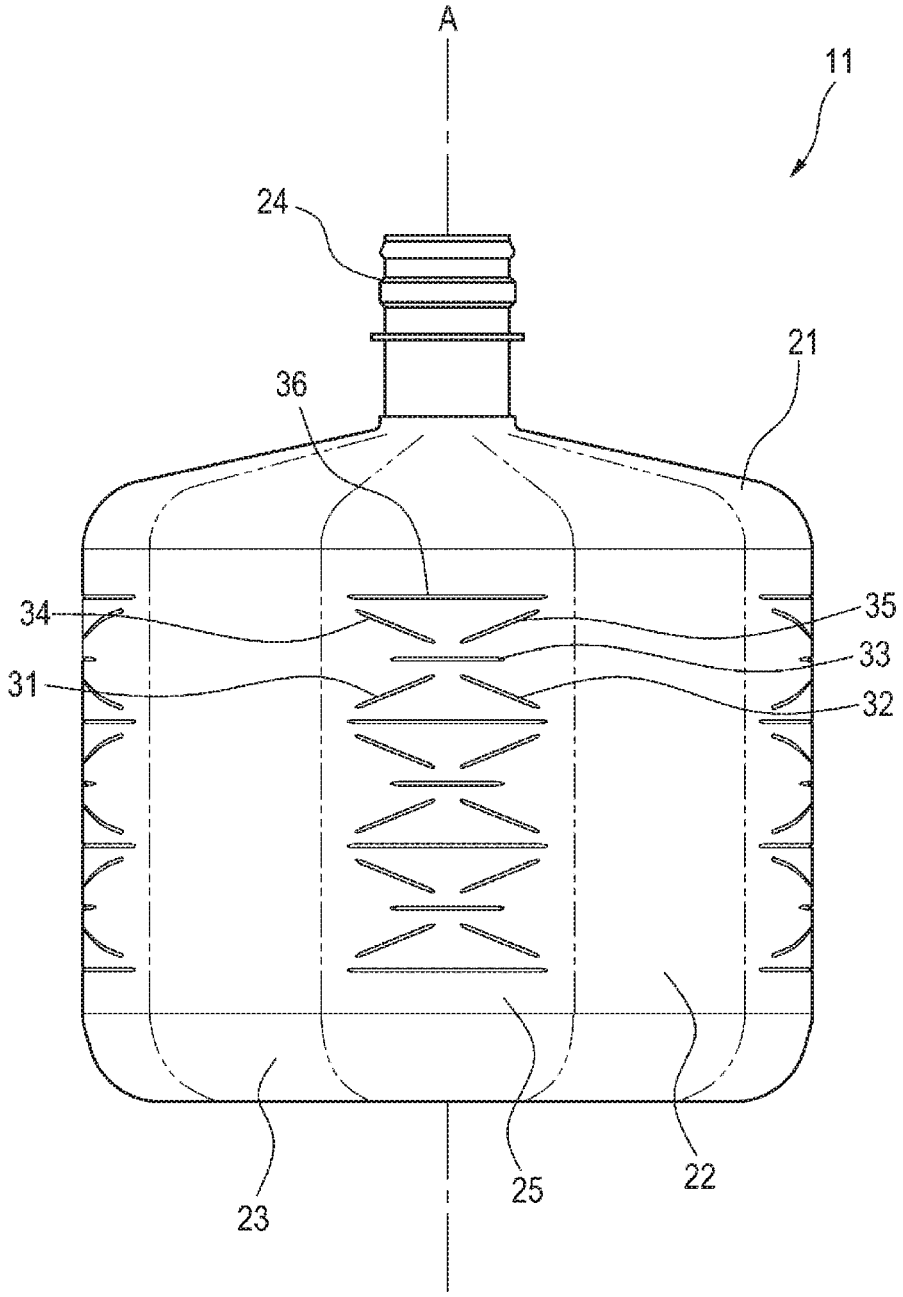
FIG. 2 is a side view showing the resin container for the water server according to the first embodiment of the present invention.
Figure 3:
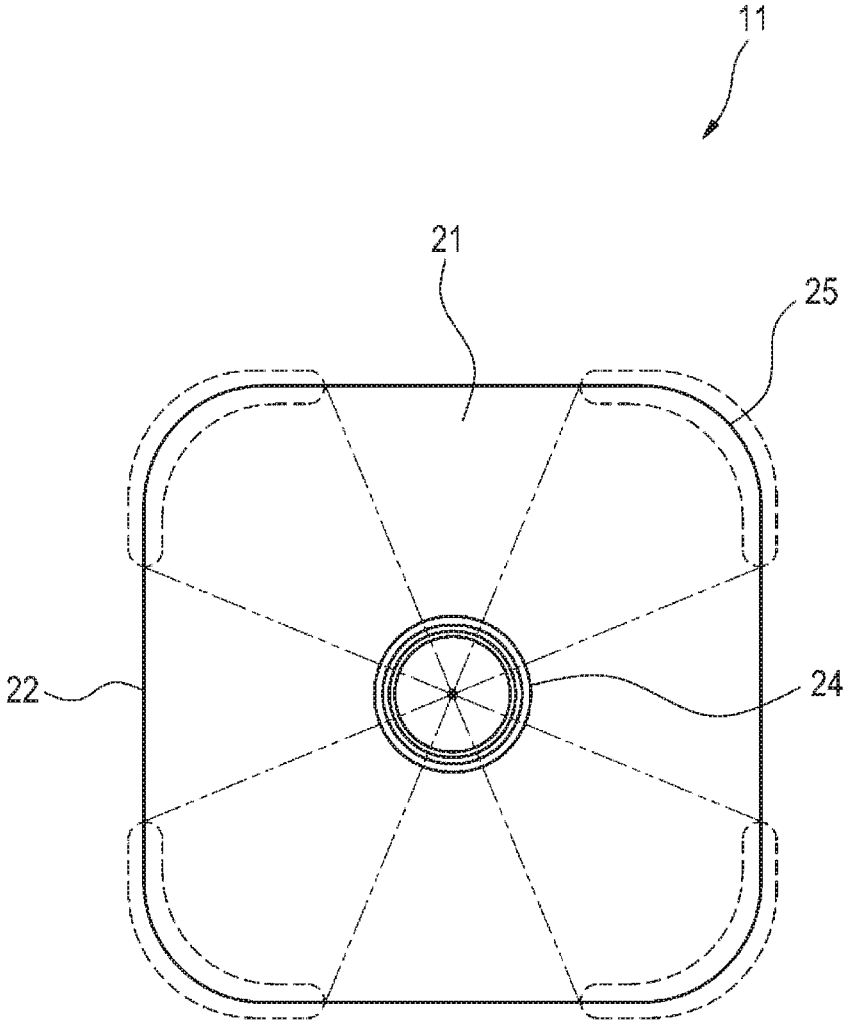
FIG. 3 is a plan view showing the resin container for the water server according to the first embodiment and a second embodiment of the present invention.
Figure 4:
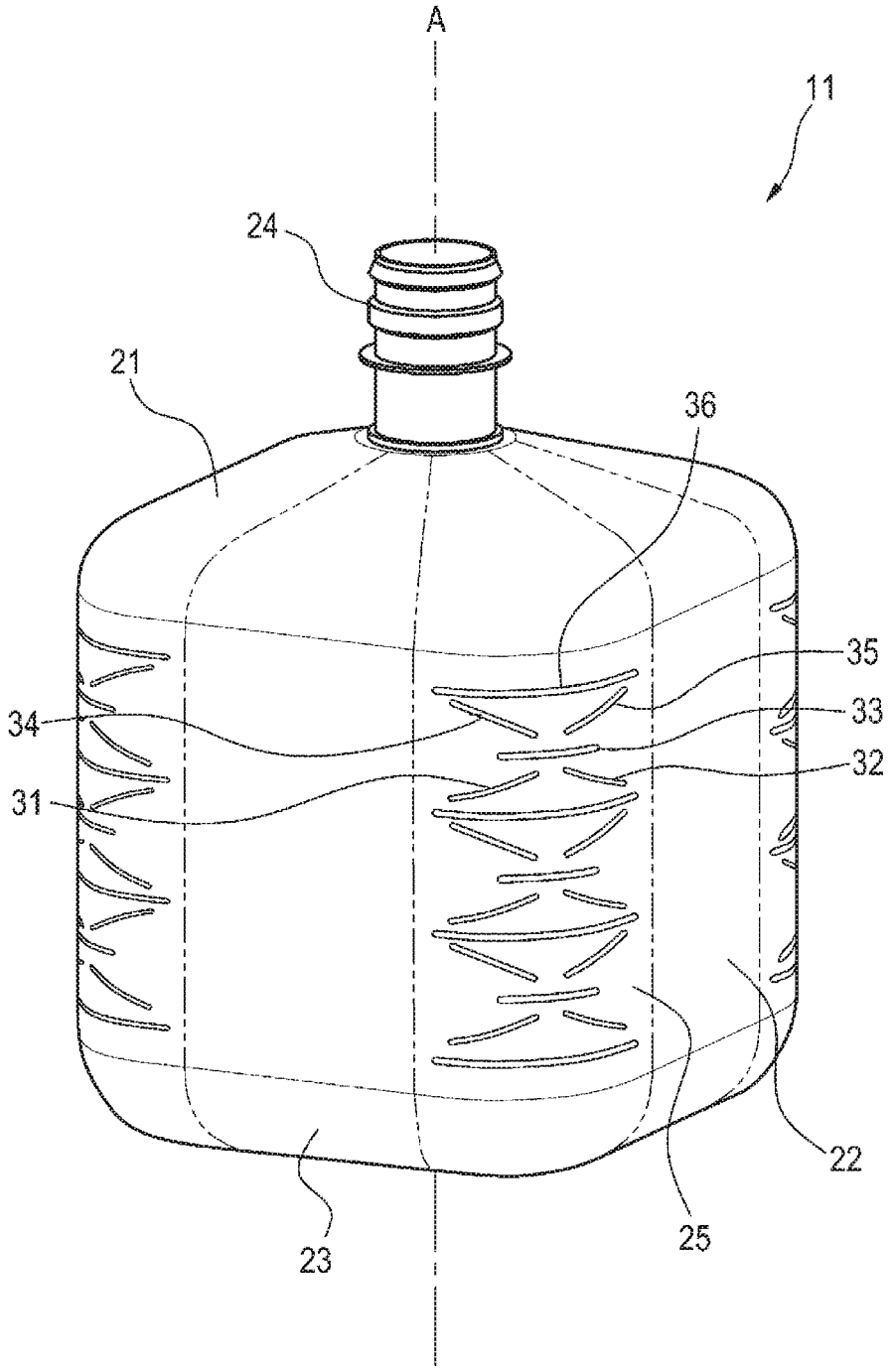
FIG. 4 is a perspective view showing the resin container for the water server according to the first embodiment of the present invention.

Round corner surface portions 25 are formed to the side surface portion 22 so that the container 11 has a square shape with round corners when the container 21 is viewed from an upper surface portion 21 side (FIG. 3). Broken lines in FIG. 3 indicate portions corresponding to the round corner surface portions 25 in the present embodiment. As shown in FIG. 3, the round corner surface portion 25 does not refer to only the portions where round corners are formed, but extend from the portion where the round corners are formed to flat portions. Two-dot chain lines in FIGS. 1 to 4 do not indicate a three-dimensional shape, but are imaginary lines for facilitating recognition of the round corner surface portion 25.

An elongated first folding deformation inducing portion 31 is formed on the round corner surface portion 25. The first folding deformation inducing portion 31 is formed so as to be oblique with respect to a central axis A passing through the inlet and outlet portion 24 of the container 11 when the container 11 is viewed from a side surface portion 22 side such that the central axis A and the round corner surface portion 25 overlap with each other (That is, when viewed as shown in FIG. 2. Hereinafter, it is simply referred to as that the container 11 is viewed from a round corner surface portion 25 side.). The term "obliquely" as used in the present specification means that an angle is larger than 0° and smaller than 90° with respect to the central axis A, or larger than 90° and smaller than 180° with respect to the central axis A.

An elongated second folding deformation inducing portion 32 is formed on the round corner surface portion 25. The second folding deformation inducing portion 32 is formed obliquely with respect to the central axis A at an inclination different from an inclination of the first folding deformation inducing portion 31 with respect to the central axis A when the container 11 is viewed from the round corner surface portion 25 side. The second folding deformation inducing portion 32 is in a line-symmetric relationship with the first folding deformation inducing portion 31 with the central axis A as a symmetry axis when the container 11 is viewed from the side surface portion 22 side such that the central axis A overlaps with a central line of the round corner surface portion 25.

An elongated third folding deformation inducing portion 33 is formed on the round corner surface portion 25. The third folding deformation inducing portion 33 is formed orthogonal to the central axis A at a position where the central axis A passes through a central point of the third folding deformation inducing portion 33 when the container 11 is viewed from the round corner surface portion 25 side.

An elongated fourth folding deformation inducing portion 34 and an elongated fifth folding deformation inducing portion 35 are formed on the round corner surface portion 25 in a line-symmetric relationship with the first folding deformation inducing portion 31 and the second folding deformation inducing portion 32 respectively with the third folding deformation inducing portion 33 as a symmetry axis when the container 11 is viewed from the round corner surface portion 25 side.

An elongated sixth folding deformation inducing portion 36 longer than the third folding deformation inducing portion 33 is formed on the round corner surface portion 25 so as to sandwich the first folding deformation inducing portion 31 to the fifth folding deformation inducing portion 35 and so as to be orthogonal to the central axis A when the container 11 is viewed from the round corner surface portion 25 side.

The first folding deformation inducing portion 31 to the sixth folding deformation inducing portion 36 are respectively recessed portions provided on the round corner surface portion 25. Three units, each of which is formed by the first folding deformation inducing portion 31 to the sixth folding deformation inducing portion 36, are formed on the round corner surface portion 25 side by side in a direction in which the central axis A extends. An angle between the first folding deformation inducing portion 31 and the second folding deformation inducing portion 32 and an angle between the fourth folding deformation inducing portion 34 and the fifth folding deformation inducing portion 35 are preferably obtuse angles of 90° or larger. Angles between the sixth folding deformation inducing portion 36 and each of the first folding deformation inducing portion 31, the second folding deformation inducing portion 32, the fourth folding deformation inducing portion 34 and the fifth folding deformation inducing portion 35, are preferably acute angles of 90° or less. The first folding deformation inducing portion 31 to the fifth folding deformation inducing portion 35 are preferably configured to be inside a horizontally long and substantially rectangular enclosure whose vertical lines are straight lines connecting left end points and right end points of the sixth folding deformation inducing portions 36, which are provided at upper and lower sides of the first folding deformation inducing portion 31 to the fifth folding deformation inducing portion 35, respectively with each other. Thereby, ease of bending (ease of folding) of the round corner surface portion 25 in a vertical direction can be improved.

The resin container 11 is put into a box-shaped accommodation portion provided at an upper portion of a water dispenser in a state of being upside down. In this state, water, which is liquid inside, is supplied to the water dispenser form the inlet and outlet portion 24 of the resin container 11.

When the water in the resin container 11 decreases as being consumed by the water dispenser, the soft resin container 11 having flexibility is deformed and the volume thereof is reduced accordingly. Therefore, air can be prevented from entering the resin container 11 with the decrease in water, thereby ensuring hygiene. At this time, the folding deformation inducing portions 31 to 36 on the round corner surface portion 25 of the side surface portion 22 serving as the peripheral surface are easily deformed with the decrease in water.

In the present embodiment, the first folding deformation inducing portion 31 recessed inward of the container 11 is provided on the round corner surface portion 25. The first folding deformation inducing portion 31 is likely to become a starting point of folding deformation and the round corner surface portion 25 of the container 11 can be prevented from becoming a support, and thus the container 11 can be crushed such that no liquid remains in the container 11. More specifically, a force applied to the container 11 in an irregular direction with liquid draining is induced by the first folding deformation inducing portion 31, so that the round corner surface portion 25 of the container 11 can be prevented from becoming a support. As a result, the container 11 can be crushed such that no liquid remains in the container 11. The irregular force is considered to be generated due to flow of water, minute variations in the thickness of the container 11 generated during molding, minute scratches and distortions on the container 11 and the like during transportation or the like. In the container 11 according to the present embodiment, regardless of the state of the container 11, the container 11 can be crushed such that no liquid remains in the container 11. Here. "the round corner surface portion 25 becomes a support" refers to, for example, a state in which the side surface portions 22 on both sides of the round corner surface portion 25 are first crushed inward, and the round corner surface portion 25 is angulated and stretched in a columnar shape in the vertical direction.

In the present embodiment, the second folding deformation inducing portion 32 recessed inward of the container 11 is further provided on the round corner surface portion, and a starting point of folding deformation is provided in conjunction with that of the first folding deformation inducing portion 31. The first folding deformation inducing portion 31 and the second folding deformation inducing portion 32 are provided in different directions from each other, whereby a force applied to the container 11 in an irregular direction can be induced such that the round corner surface portion 25 of the container 11 does not further become a support.

In the present embodiment, the third folding deformation inducing portion 33 recessed inward of the container 11 is further provided on the round corner surface portion 25, and a starting point of folding deformation is provided in conjunction with those of the first folding deformation inducing portion 31 and the second folding deformation inducing portion 32. In addition to the first folding deformation inducing portion 31 and the second folding deformation inducing portion 32 provided in different directions from each other, the third folding deformation inducing portion 33 is provided so as to be orthogonal to the central axis A. Thereby, a force applied to the container 11 in an irregular direction can be induced such that the round corner surface portion 25 of the container 11 does not further become a support and the round corner surface portion 25 is folded and deformed inward.

In the present embodiment, the fourth folding deformation inducing portion 34 to the sixth folding deformation inducing portion 36 that are recessed inward of the container 11 are further provided on the round corner surface portion 25, and thus a region for inducing folding deformation is provided. Since the folding deformation can be induced by the region, a force applied to the container 11 in an irregular direction can be induced in a wide range.

In the present embodiment, three regions for inducing the above-described folding deformation are provided on the round corner surface portion 25 in the direction in which the central axis A extends. Thereby, a force applied to the container 11 in an irregular direction can be induced in a wide range with respect to the direction in which the central axis A extends.

Second Embodiment

Figure 5:
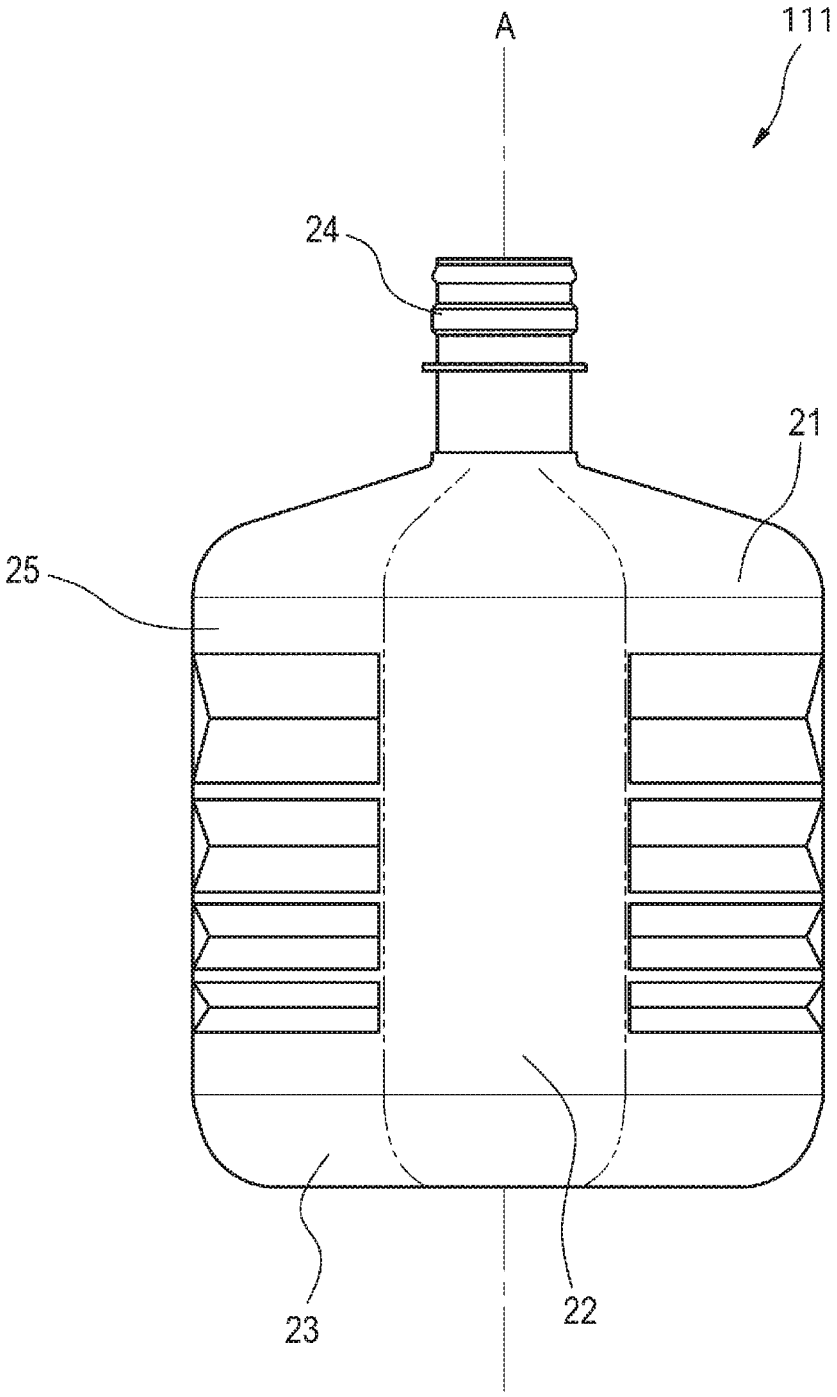
FIG. 5 is a side view showing the resin container for the water server according to the second embodiment of the present invention.
Figure 6:
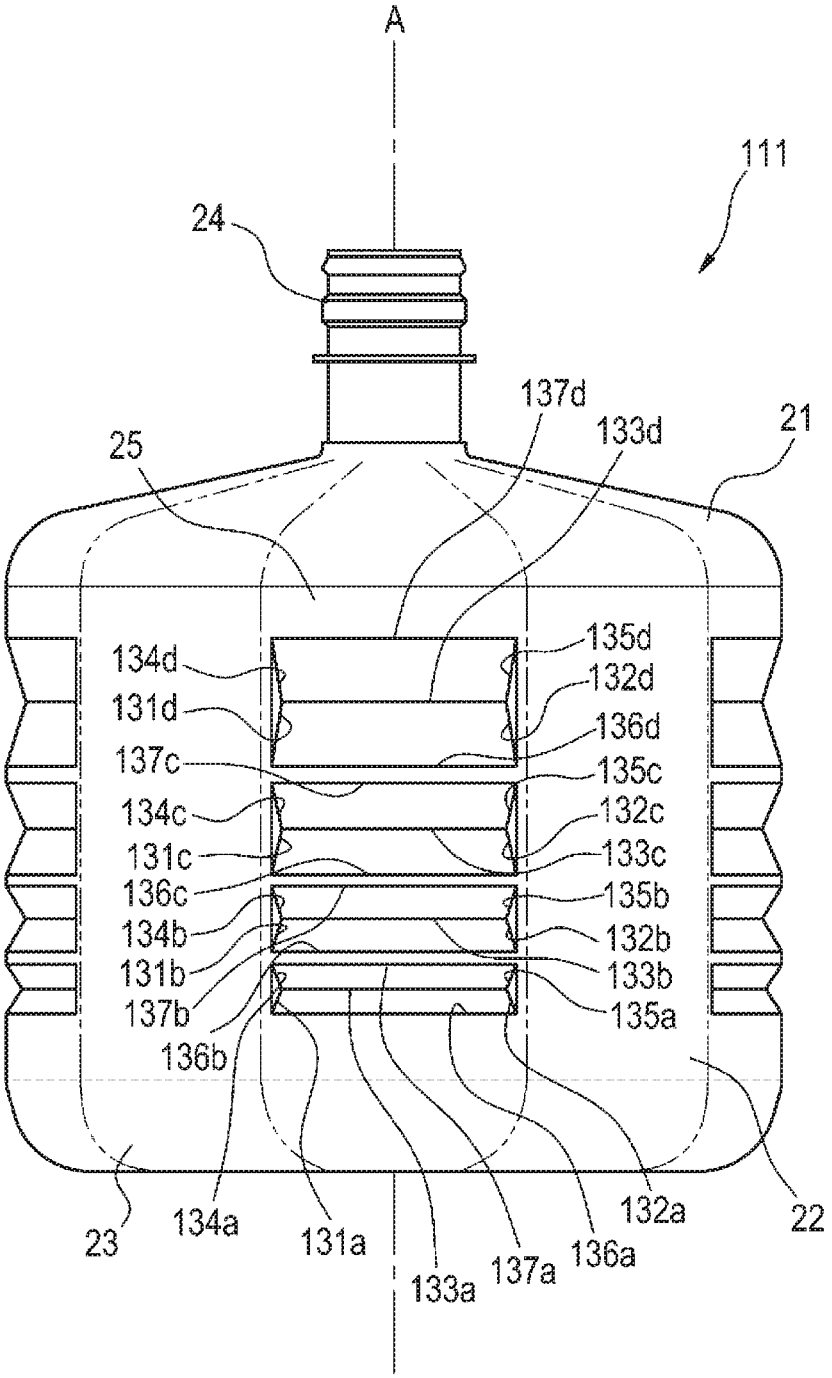
FIG. 6 is a side view showing the resin container for the water server according to the second embodiment of the present invention.
Figure 7:
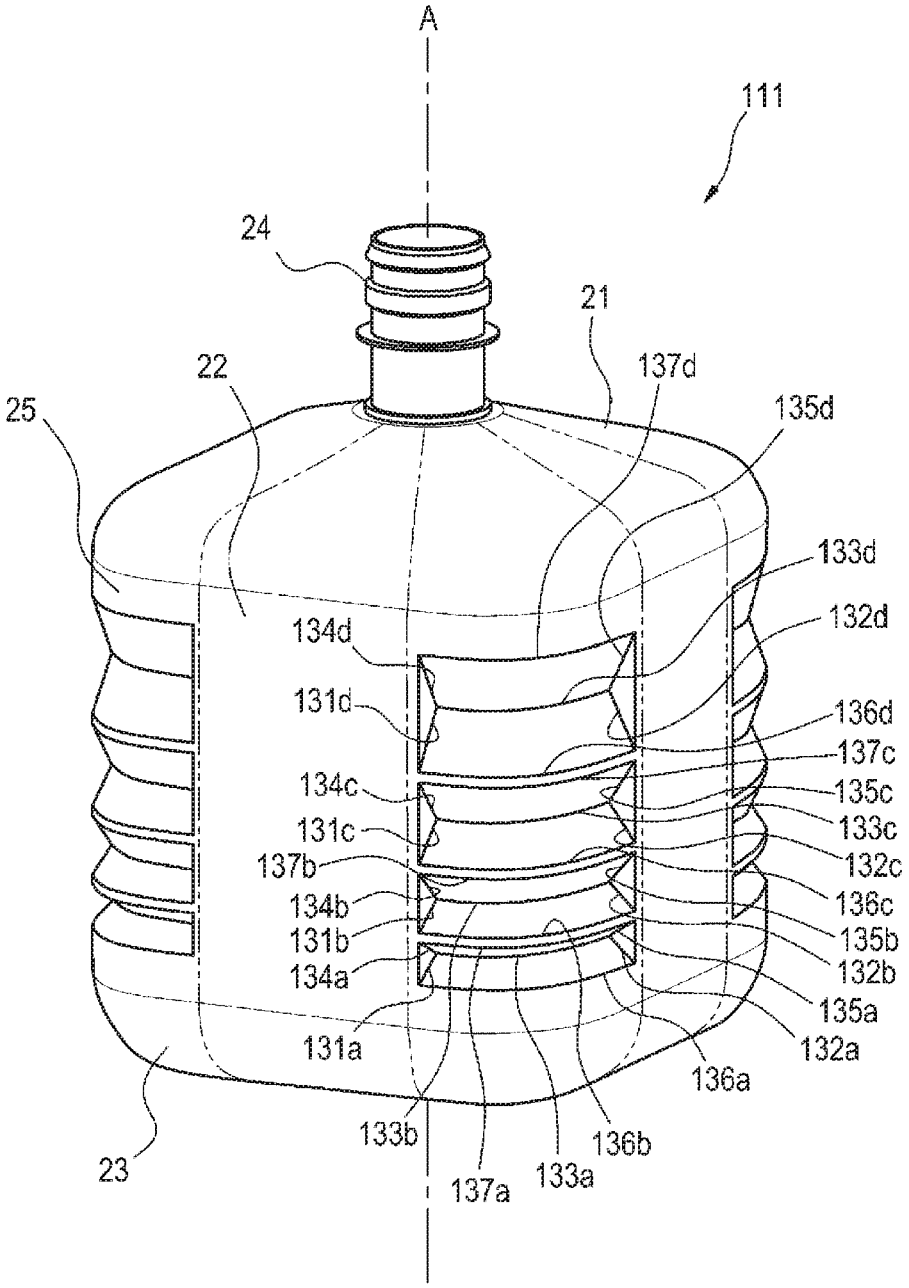
FIG. 7 is a perspective view showing the resin container for the water server according to the second embodiment of the present invention.

FIGS. 5 to 7 are views showing a resin container 111 according to a second embodiment of the present invention. The resin container 111 according to the present embodiment is similar to the resin container 11 according to the first embodiment except that a folding deformation inducing portion formed on the round corner surface portion 25 is different. Two-dot chain lines in FIGS. 5 to 7 do not indicate a three-dimensional shape, but are imaginary lines for facilitating recognition of the round corner surface portion 25.

In the present embodiment, elongated first folding deformation inducing portions 131 (131*a*, 131*b*, 131*c* and 131*d* are collectively referred to as 131) are formed on the round corner surface portion 25. The first folding deformation inducing portion 131 is formed obliquely with respect to the central axis A passing through the inlet and outlet portion 24 of the container 111 when the container 111 is viewed from a side surface portion 22 side such that the central axis A and the round corner surface portion 25 overlap with each other (That is, when viewed as shown in FIG. 6. Hereinafter, it is simply referred to that the container 111 is viewed from a round corner surface portion 25 side.).

Elongated second folding deformation inducing portions 132 (132*a*, 132*b*, 132*c* and 132*d* are collectively referred to as 132) are formed on the round corner surface portion 25. The second folding deformation inducing portion 132 is formed obliquely with respect to the central axis A at an inclination different from an inclination of the first folding deformation inducing portion 131 with respect to the central axis A when the container 111 is viewed from the round corner surface portion 25 side. The second folding deformation inducing portion 132 is in a line-symmetric relationship with the first folding deformation inducing portion 131 with the central axis A as a symmetry axis when the container 111 is viewed from the side surface portion side such that the central axis A overlaps with a central line of the round corner surface portion 25.

Elongated third folding deformation inducing portions 133 (133*a*, 133*b*, 133*c* and 133*d* are collectively referred to as 133) are formed on the round corner surface portion 25. The third folding deformation inducing portion 133 is formed orthogonal to the central axis A at a position where the central axis A passes through a central point of the third folding deformation inducing portion 133 when the container 11 is viewed from the round corner surface portion 25 side. The first folding deformation inducing portion 131, the second folding deformation inducing portion 132 and the third folding deformation inducing portion 133 are formed continuously.

Elongated fourth folding deformation inducing portions 134 (134*a*, 134*b*, 134*c* and 134*d* are collectively referred to as 134) and elongated fifth folding deformation inducing portions 135 (135*a*, 135*b*, 135*c* and 135*d* are collectively referred to as 135) are formed on the round corner surface portion 25 in a line-symmetric relationship with the first folding deformation inducing portions 131 and the second folding deformation inducing portions 132 respectively with the third folding deformation inducing portions 133 as symmetry axes when the container 111 is viewed from the round corner surface portion 25 side. The third folding deformation inducing portion 133, the fourth folding deformation inducing portion 134 and the fifth folding deformation inducing portion 135 are formed continuously.

Elongated sixth folding deformation inducing portions 136 (136*a*, 136*b*, 136*c* and 136*d* are collectively referred to as 136) and elongated seventh folding deformation inducing portions 137 (137*a*, 137*b*, 137*c* and 137*d* are collectively referred to as 137) that are longer than the third folding deformation inducing portions 133 are formed on the round corner surface portion 25 so as to sandwich the first folding deformation inducing portions 131 to the fifth folding deformation inducing portions 135 and so as to be orthogonal to the central axis A when the container 111 is viewed from the round corner surface portion 25 side. The first folding deformation inducing portion 131, the second folding deformation inducing portion 132 and the sixth folding deformation inducing portion 136 are formed continuously. The fourth folding deformation inducing portion 134, the fifth folding deformation inducing portion 135 and the seventh folding deformation inducing portion 137 are formed continuously.

The first folding deformation inducing portion 131 and the second folding deformation inducing portion 132 are formed so as to be directed inward of the container 111 as they extend from end portions of the sixth folding deformation inducing portion 136 side toward end portions of the third folding deformation inducing portion 133. The fourth folding deformation inducing portion 134 and the fifth folding deformation inducing portion 135 are formed so as to be directed inward of the container 111 as they extend from end portions of the seventh folding deformation inducing portion 137 toward the end portions of the third folding deformation inducing portion 133. Four units, each of which is formed by the first folding deformation inducing portion 131 to the seventh folding deformation inducing portion 137, are formed side by side in a direction in which the central axis A extends.

A trapezoid, in which the first folding deformation inducing portion 131 and the second folding deformation inducing portion 132 serve as legs, the third folding deformation inducing portion 133 serves as an upper base and the sixth folding deformation inducing portion 136 serves as a lower base, can be seen on the round corner surface portion 25 when the container 111 is viewed from the round corner surface portion 25 side. A trapezoid, in which the fourth folding deformation inducing portion 134 and the fifth folding deformation inducing portion 135 serve as legs, the seventh folding deformation inducing portion 133 serves as an upper base and the third folding deformation inducing portion 133 serves as a lower base, can be seen on the round corner surface portion 25 when the container 111 is viewed from the round corner surface portion 25 side.

In a first unit formed by the first folding deformation inducing portion 131*a* to the seventh folding deformation inducing portion 137*a* that are closest to the bottom surface portion 23 of the container 111, two trapezoids symmetrical with respect to the third folding deformation inducing portion 133*a* are formed when the container 111 is viewed from the round corner surface portion 25 side. In a second unit formed by the first folding deformation inducing portion 131*b* to the seventh folding deformation inducing portion 137*b* that are the second closest to the bottom surface portion 23 of the container 111, similar two trapezoids are formed. In a third unit formed by the first folding deformation inducing portion 131*c* to the seventh folding deformation inducing portion 137*c* that are the third closest to the bottom surface portion 23 of the container 111, similar two trapezoids are formed. In a fourth unit formed by the first folding deformation inducing portion 131*d* to the seventh folding deformation inducing portion 137*d* that are the fourth closest to the bottom surface portion 23 of the container 11, similar two trapezoids are formed. The height of the trapezoids seen in each unit increases from a bottom surface portion 23 side toward an upper surface portion 21 side.

In the present embodiment, the first folding deformation inducing portion 131, which is directed inward of the container 111 as it extends from an end portion of the sixth folding deformation inducing portion 136 side toward an end portion of the third folding deformation inducing portion 133, is provided on the round corner surface portion 25. The first folding deformation inducing portion 131 is likely to be a starting point of folding deformation. Thereby, the round corner surface portion 25 of the container 111 can be prevented from becoming a support, and thus the container 111 can be crushed such that no liquid remains in the container 111. More specifically, a force applied to the container 111 in an irregular direction with liquid draining is induced by the first folding deformation inducing portion 131, so that the round corner surface portion 25 of the container 111 can be prevented from becoming a support. As a result, the container 111 can be crushed such that no liquid remains in the container 111. The irregular force is considered to be generated due to flow of water, minute variations in the thickness of the container 111 generated during molding, minute scratches and distortions on the container 11 and the like during transportation or the like. In the container 111 according to the present embodiment, regardless of such state of the container 111, the container 111 can be crushed such that no liquid remains in the container 111.

In the present embodiment, the second folding deformation inducing portion 132, which is directed inward of the container 111 as it extends from an end portion of the sixth folding deformation inducing portion 136 toward an end portion of the third folding deformation inducing portion 133, is further provided on the round corner surface portion 25, and a starting point of folding deformation is provided in conjunction with that of the first folding deformation inducing portion 131. The first folding deformation inducing portion 131 and the second folding deformation inducing portion 132 are provided in different directions from each other, whereby a force applied to the container 111 in an irregular direction can be induced such that the round corner surface portion 25 of the container 111 does not further become a support.

In the present embodiment, the third folding deformation inducing portion 133 is further provided inward of the container 111 than the sixth folding deformation inducing portion 136, and a starting point of folding deformation is provided in conjunction with those of the first folding deformation inducing portion 131 and the second folding deformation inducing portion 132. In addition to the first folding deformation inducing portion 131 and the second folding deformation inducing portion 132 provided in different directions from each other, the third folding deformation inducing portion 133 is provided so as to be orthogonal to the central axis A. Thereby, a force applied to the container 111 in an irregular direction can be induced such that the round corner surface portion 25 of the container 111 does not further become a support and the round corner surface portion 25 is folded and deformed inward.

In the present embodiment, the fourth folding deformation inducing portion 134 and the fifth folding deformation inducing portion 135, which are directed inward of the container 111 as they extend from end portions of the seventh folding deformation inducing portion 137 toward end portions of the third folding deformation inducing portion 133, are further provided on the round corner surface portion 25. A region for inducing folding deformation is provided by the first folding deformation inducing portion 131 to the seventh folding deformation inducing portion 137. Since the folding deformation can be induced by the region, a force applied to the container 111 in an irregular direction can be induced in a wide range.

In the present embodiment, four regions for inducing the above-described folding deformation are provided on the round corner surface portion 25 in the direction in which the central axis A extends. Thereby, a force applied to the container 111 in an irregular direction can be induced in a wide range with respect to the direction in which the central axis A extends.

In the resin container 111 for a water server, the side surface portion 22 on the bottom surface portion 23 side is crushed before the side surface portion 22 on the upper surface portion 21 side when the liquid in the container 111 is drained. By reducing the height of the trapezoid seen in the first unit closest to the bottom surface portion 23 of the container 111, deformation of the container 111 can be easily induced at the beginning of liquid draining, and the round corner surface portion 25 of the container 111 can be prevented from becoming a support. When the liquid draining proceeds, since support by the liquid is lost as the liquid inside decreases, the vertical length of the deformation of the container 111 often increases. By increasing the height of the trapezoid seen in each unit toward the upper surface portion 21 side of the container 111, deformation of the container 111 is easily induced also at the middle and end of the liquid draining, and the round corner surface portion 25 of the container 111 can be prevented from becoming a support.

In the first embodiment described above, a trapezoid, in which the first folding deformation inducing portion 31 and the second folding deformation inducing portion 32 serve as legs, an imaginary line connecting end portions of the first folding deformation inducing portion 31 and the second folding deformation inducing portion 32 on a third folding deformation inducing portion 33 side serves as an upper base and an imaginary line connecting end portions of the first folding deformation inducing portion 31 and the second folding deformation inducing portion 32 on a sixth folding deformation inducing portion 36 side serves as a lower base, can be seen on the round corner surface portion 25 when the container 11 is viewed from the round corner surface portion 25 side. In addition, a trapezoid, in which the fourth folding deformation inducing portion 34 and the fifth folding deformation inducing portion 35 serve as legs, an imaginary line connecting end portions of the fourth folding deformation inducing portion 34 and the fifth folding deformation inducing portion 35 on the sixth folding deformation inducing portion 36 side serves as an upper base and an imaginary line connecting end portions of the fourth folding deformation inducing portion 34 and the fifth folding deformation inducing portion 35 on the third folding deformation inducing portion 33 side serves as a lower base, can be seen on the round corner surface portion 25 when the container 11 is viewed from the round corner surface portion 25 side. That is, two trapezoids can be seen in one unit formed by the first folding deformation inducing portion 31 to the sixth folding deformation inducing portion 36.

Also in the first embodiment, the first folding deformation inducing portion 31 to the sixth folding deformation inducing portion 36 may be formed such that the height of the trapezoid seen in each unit increases from the bottom surface portion 23 side toward the upper surface portion 21 side. By reducing the height of the trapezoid seen in the unit closest to the bottom surface portion 23 of the container 11, deformation of the container 11 can be easily induced at the beginning of liquid draining, and the round corner surface portion 25 of the container 11 can be prevented from becoming a support. By increasing the height of the trapezoid seen in each unit toward the upper surface portion 21 side of the container 11, deformation of the container 11 is easily induced also at the middle and end of the liquid draining, and the round corner surface portion 25 of the container 11 can be prevented from becoming a support.

As described above, according to the embodiment, a resin container for a water server which is capable of preventing liquid from remaining in the container can be provided.

The present invention is not limited to the above-described embodiments, and modifications, improvements and the like can be made as appropriate. In addition, the material, shape, size, number, arrangement position and the like of each component in the above-described embodiments are optional and are not limited as long as the present invention can be achieved. For example, the container may have a substantially rectangular parallelepiped shape.

The present application is based on Japanese Patent Application No. 2017-069778 filed on Mar. 31, 2017, the contents of which are incorporated herein by reference. In addition, all references cited herein are incorporated in their entirety.

REFERENCE SIGNS LIST

11, 111: resin container, 21: upper surface portion, 22: side surface portion, 23: bottom surface portion, 24: inlet and outlet portion, 25: round corner surface portion, 31, 131: first folding deformation inducing portion, 32, 132: second folding deformation inducing portion, 33, 133: third folding deformation inducing portion, 34, 134: fourth folding deformation inducing portion, 35, 135: fifth folding deformation inducing portion, 36, 136: sixth folding deformation inducing portion, 137: seventh folding deformation inducing portion, A: central axis

The invention claimed is:

1. A resin container for a water server, which is capable of accommodating a predetermined amount of liquid and has flexibility, the container being crushed with draining of the liquid, the container comprising:

an upper surface portion to which a liquid inlet and outlet portion is formed;

a side surface portion connected to the upper surface portion; and a bottom surface portion disposed on a side opposite to the upper surface portion and connected to the side surface portion, wherein a round corner surface portion is formed to the side surface portion such that the container has a polygonal shape with round corners when the container is viewed from an upper surface portion side, wherein an elongated first folding deformation inducing portion is formed on the round corner surface portion, wherein, when the container is viewed from a side surface portion side such that a central axis of the container passing through the liquid inlet and outlet portion and the round corner surface portion overlap with each other, the first folding deformation inducing portion is oblique with respect to the central axis, wherein the side surface portion includes a flat surface portion extending from the upper surface portion to the bottom surface portion prior to the resin container being crushed, wherein an elongated second folding deformation inducing portion is formed on the round corner surface portion, wherein, when the container is viewed from the side surface portion side such that the central axis and the round corner surface portion overlap with each other, the second folding deformation inducing portion is oblique with respect to the central axis at an inclination different from an inclination of the first folding deformation inducing portion with respect to the central axis, wherein, when the container is viewed from the side surface portion side such that the central axis and the round corner surface portion overlap with each other, in a trapezoid in which the first folding deformation inducing portion and the second folding deformation inducing portion serve as legs, a line connecting end portions of the first folding deformation inducing portion and the second folding deformation inducing portion on the upper surface portion side serves as an upper base, and a line connecting end portions of the first folding deformation inducing portion and the second folding deformation inducing portion on a bottom surface portion side serves as a lower base, the upper base and the lower base are orthogonal to the central axis, wherein a plurality of the trapezoids are provided in a direction of the central axis, wherein a height of the trapezoid closest to the upper surface portion is greater than a height of the trapezoid closest to the bottom surface portion, and wherein, among adjacent trapezoids, a height of the trapezoid on the upper surface side is equal to or greater than a height of the trapezoid on the bottom surface side.

2. The resin container according to claim 1, wherein an elongated third folding deformation inducing portion is formed on the round corner surface portion, and wherein, when the container is viewed from the side surface portion side such that the central axis and the round corner surface portion overlap with each other, the third folding deformation inducing portion is orthogonal to the central axis.

3. The resin container according to claim 1, wherein the flat surface portion is connected to the round corner surface portion.

* * * * *